United States Patent [19]

Afonin et al.

[11] 4,071,188

[45] Jan. 31, 1978

[54] CENTRIFUGAL SEPARATOR FOR TREATING LIQUIDS

[76] Inventors: Mikhail Egorovich Afonin, ulitsa Krasny Mayak 7, korpus 2, kv. 76; Petr Nikolaevich Belyanin, ulitsa Marshala Tukhachevskogo, 23, korpus 2, kv. 186; Andrei Konstantinovich Ivanov, ulitsa Volgina, 31, korpus 1, kv. 87, all of Moscow, U.S.S.R.

[21] Appl. No.: 717,003

[22] Filed: Aug. 23, 1976

[51] Int. Cl.[2] ..... B04B 1/08; B04B 11/02

[52] U.S. Cl. ..... 233/29; 233/47 R

[58] Field of Search ..... 233/27, 28, 29, 34, 233/35, 38, 39, 40, 41, 46, 47 R

[56] References Cited

U.S. PATENT DOCUMENTS

| | | | |
|---|---|---|---|
| 797,297 | 8/1905 | Ljungstrom | 233/29 |
| 825,412 | 7/1906 | Pawley | 233/29 |
| 1,120,464 | 12/1914 | Falk | 233/29 |
| 2,808,201 | 10/1957 | Mayeux | 233/28 |
| 3,279,686 | 10/1966 | Hubmann | 233/29 X |

FOREIGN PATENT DOCUMENTS

| | | | |
|---|---|---|---|
| 674,998 | 10/1929 | France | 233/29 |
| 348,501 | 3/1922 | Germany | 233/27 |

*Primary Examiner*—George H. Krizmanich
*Attorney, Agent, or Firm*—Steinberg & Blake

[57] ABSTRACT

A centrifugal separator adapted for treating various liquids has a stack of trays set on a drive shaft. To keep the trays somewhat apart from one another, disks are interposed between the trays and provided with holes open along their periphery. The trays are provided with disk and tray holes coaxial with the holes in the disks. The holes form ducts for feeding the polluted liquid and ducts for discharging the purified liquid, both ducts passing parallel to the shaft axis. The liquid is passed from one duct to the other along an arc of a circle in the intertray space. The effect of the flow of the liquid on the settling of solids is insignificant, which enables higher efficiency of the process. The present invention can be applied in diverse fields of technology, where separation of different-density substances is involved.

7 Claims, 7 Drawing Figures

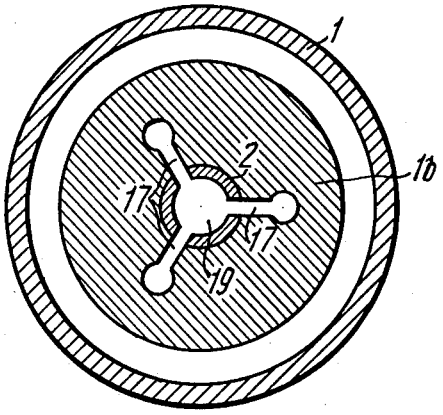
VI FIG. 4
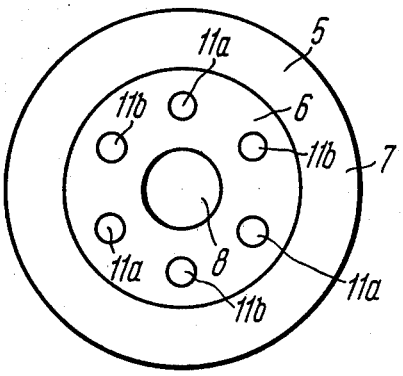
VI FIG. 5
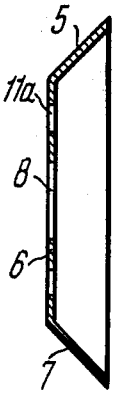
FIG. 6
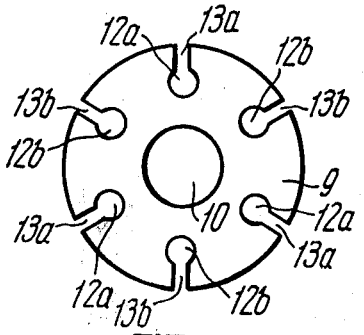
FIG. 7

CENTRIFUGAL SEPARATOR FOR TREATING LIQUIDS

The present invention relates generally to devices for separating substances differing in density and, more specifically, to centrifugal separators for cleaning various liquids.

The centrifugal separator according to the present invention can be used to good advantage for getting lube oils, liquid fuels or hydraulic fluids of transport vehicles rid of impurities and admixtures.

The invention can also be practicable in surface-coating, dairy and chemical-engineering industries, as well as in some other branches of technology, wherein separation of different-density matters is involved.

One prior-art centrifugal separator for liquid cleaning comprises a shell shaped as body of revolution and having the shell interior communicating with a source of polluted liquids to be processed and with a discharge line for the purified liquid.

The shell accommodates a shaft rotatable from a motor and rigidly coupled to the shell.

The shaft carries a holder to which a stack of cone-shaped trays is attached, said trays being so spaced apart to one another so as to leave a free space therebetween for the liquid under process to pass through. Provided between the trays are the spacing members adapted to keep the trays some distance apart from one another, said members in the known-design centrifugal separator being made as projections defined on the surface of each tray, or ribs provided on the bevelled surfaces of the trays and arranged radially with respect to the shaft geometric axis.

Each of the trays has a central hole for the shaft to pass, and at least one hole to form a duct or flow passage for the contaminated liquid to flow from the source to the intertray space. The duct runs inside the shell and is formed by coaxial holes in the trays.

Another duct or flow passage adapted for the purified liquid to let out to the discharge line, is confined by the outer cylindrical surface of the holder and the faces of the central holes in the trays, said faces being spaced somewhat apart from the outer holder surface.

Both of said ducts runs substantially parallel to the shaft geometric axis and intercommunicate through the intertray space (cf. the centrifugal separator, Model PX-207-00S available from "De Laval Co.," Sweden).

In said known centrifugal machine the contaminated liquid is fed from its source to the duct formed by the holes in the trays, to pass therebetween towards the shaft geometric axis so that admixtures and impurities contained in the liquid are displaced, by virtue of the centrifugal forces, towards the bevelled tray surface, slip thereover towards the tray periphery to get into the annular gap between the shell and the tray peripheries, cross said gap and settle down upon the shell inner surface. The thus-cleaned liquid flows along the intertray space to the outlet duct and then to the discharge line.

In the heretofore known centrifugal separators the liquid flow in the intertray space is directed radially, a feature that proves to be substantially disadvantageous by the following reasons.

Solid impurities or contaminants are liable to fall from the peripheral edge of each tray and settle down upon the shell inner surface.

The lightest particles may be entrained by the flow of liquid to be returned to the intertray space.

The radial flow of liquid within the intertray space makes difficult the slipping of impurity particles over the trays in the course of their movement towards the tray edges.

When high-viscosity liquid is to be separated from solid impurities having a very small size, the radial flow of liquid might stop completely the slipping of solids over the tray surface, whereas further increase of the viscosity of the liquid and reduction of the size and density of contaminant solids might result even in their backward motion, i.e., towards the shaft.

Moreover, the liquid flow width, narrowing as it approximates the axis of rotation, is liable to be swirled into vortices.

The flow velocity of liquid is increased many times so that the minutest solids are liable to be entrained and carried away by the vortices thus making worse the settling conditions for the solids.

All the aforeconsidered peculiar features inherent in separation of the solids in the case of radial flow of liquid within the intertray space in the heretofore known centrifugal separators compel one to substantially restrict the flow velocity of liquid, with the result that the cleaning process occurs at inadequately high flow rates which adversely affects the efficiency of the cleaning process.

The actual throughput capacity of the centrifugal separator proves to be rather lower than that estimated theoretically for ideal settling conditions.

It is therefore an essential object of the present invention to provide a centrifugal separator for cleaning various liquids, featuring such a construction as to minimize the effect of the flow of the liquid under process upon the solids settling process as compared to the heretofore known centrifugal separators used for similar purposes, which would be instrumental in achieving substantially higher efficiency of the process with the quality of liquid purification remaining unaffected.

Said object is accomplished due to the fact that in a centrifugal separator for cleaning various liquids, comprising a shell whose interior is communicated with a source of the contaminated liquid to be processed and with a discharge line for the cleaned up liquid, said shell accommodating a drive shaft rigidly coupled thereto for a joint rotation therewith, said shaft carrying a stack of trays with members interposed between them and adapted to keep the trays somewhat apart from one another, provision being therein made for at least one duct or flow passage for the contaminated liquid to be fed from its source to the intertray space, and a duct or flow passage for the cleaned up liquid to let out to the discharge line, both of said ducts running substantially parallel to the shaft geometric axis, wherein according to the invention, said members are made essentially as spacer disks slipped over the shaft and having an outside diameter substantially the same as the diameter of the tray bottom, whereas each of said ducts or flow passages is defined by coaxial holes provided by at least one in each tray for each of the ducts in such a way that the holes that form each of the ducts are spaced equidistantly along the periphery of each tray, whereby the liquid under process is free to pass from one duct to the other along a path which is substantially a circumferential arc running within the intertray space.

With the liquid flowing along an arcuate path, the space confined within the peripheral edges of the trays and the inner walls of the shell is essentially a stagnation region since no flow of liquid takes place therein. Thereby the liquid renders no effects upon the movement of the solids separated therefrom which enables even the minutest particles to deposit unobstructedly upon the inner shell wall. So in this case any possibility for the solids to be recarried to the intertray space is practically excluded.

Besides, an arcuate path of the liquid makes the flow area constant, whereby each elementary stream of liquid has a constant flow velocity while passing through the intertray space which minimizes vortex formation in the flow of liquid that might entrain the solids to be settled down in a direction other than radial, towards the shell inner wall.

Another advantageous feature of an arcuate path of the flow of liquid resides in the fact that the direction of the flow of liquid in the intertray space is other than the direction of slipping of the solids over the tray surface which is in fact a radial one from the axis of rotation towards the shell wall, differing therefrom by substantially 90°, a feature whereby the effect of the flow of liquid upon the process of solids slipping over the tray surface is much lessened which allows high velocities of the flow of liquid within the intertray space.

It is expedient that the holes in the trays forming the ducts for the polluted liquid and for the cleaned-up liquid to let out to the discharge line be made in the tray bottom and coaxially thereto in the spacer disks, said holes in each of the latter being peripherally open.

Such a constructional arrangement proves to be a simplest engineering solution of the problem of an arcuate-path flow of liquid in the intertray space.

Purification of liquids by resorting to the centrifugal separator as disclosed in the present invention is instrumental in attaining a considerable gain in the efficiency as compared to the heretofore known centrifugal separators used for similar purposes under similar process conditions (geometric size, rotation speed, viscosity of the liquid under process, size and density of solids to be settled).

Given below is a detailed description of a preferred embodiment of the present invention given by way of example with reference to the accompanying drawings, wherein:

FIG. 4 is a sectional view taken along the line IV—IV of FIG. 1;

FIG. 5 is an elevation view of a tray;

FIG. 6 is a sectional view taken along the line VI—VI of FIG. 5;

FIG. 7 is a general view of a spacer disk.

Referring to the accompanying drawings, the centrifugal separator for cleaning various liquids comprises a shell 1 (FIG. 1) which is rigidly coupled to a shaft 2 (FIGS. 1,2,3,4) accommodated in the shell interior coaxially therewith. The shaft 2 rests upon a stationary fixed support 3 (FIG. 1) and runs in bearings 4 provided on its journal extensions.

The shaft 2 obtains rotation along with the shell 1 from an electric drive motor (not shown). The interior of the shell 1 communicates with a source (not shown) of the contaminated liquid to be processed and with a discharge line (not shown) for the cleaned-up liquid.

Figure 1:
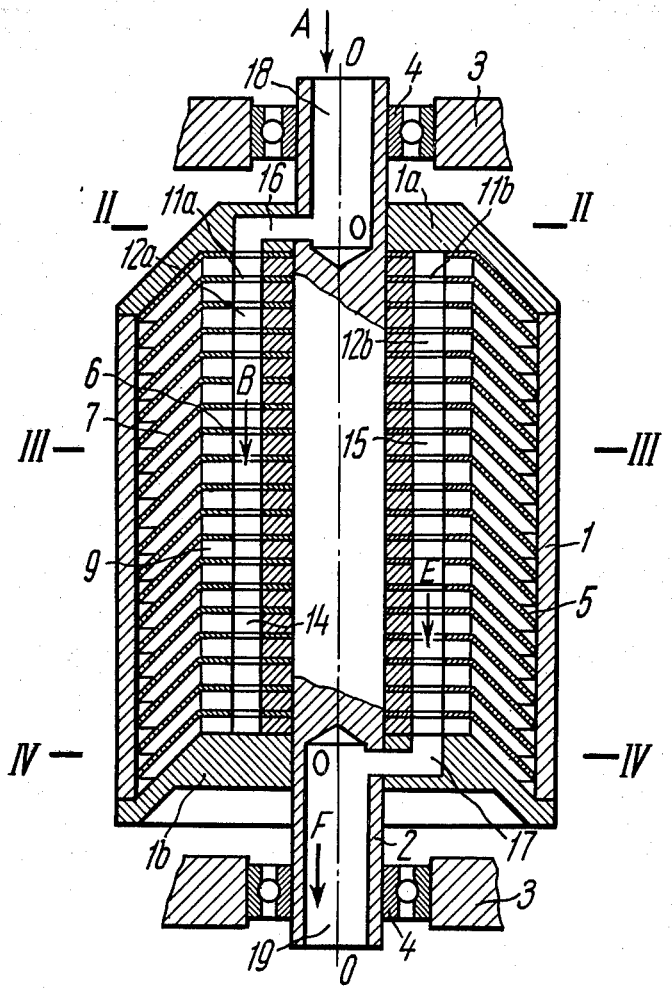
FIG. 1 is a schematic longitudinal-section view through a centrifugal separator for cleaning various liquids, according to the invention.
Figure 2:
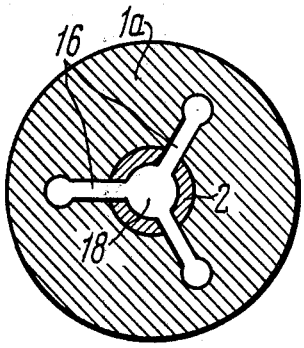
FIG. 2 is a sectional view of FIG. 1 taken along the line II—II.
Figure 3:
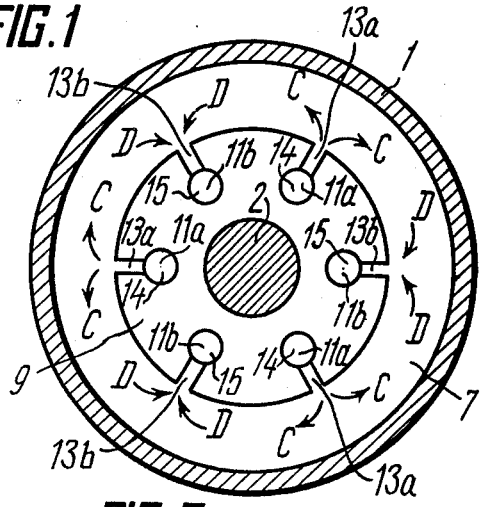
FIG. 3 is a sectional view taken along the line III—III of FIG. 1.

The shaft 2 carries a stack 5 of trays (FIGS. 1,3).

In the given particular embodiment of the present invention, each of the trays 5 has a bottom 6 (FIGS. 5,6) and a tapered side wall 7. The bottom 6 of each tray 5 has a central hole 8 with a diameter equal to the diameter of the shaft 2 the latter passing through said hole.

To keep the trays 5 somewhat apart from one another, provision is made for spacer members interposed between the trays 5 coaxially with the shaft 2. In the herein-disclosed specific embodiment of the present invention, said members are made essentially as spacer disks 9 (FIGS. 1,3) with flat parallel faces, having an outer diameter substantially the same as the diameter of the bottom 6 of the trays 5. Each of the spacer disks 9 has a central hole 10 (FIG. 7) with a diameter equal to that of the shaft 2 the latter passing through said hole.

The bottom 6 of each tray 5 has six holes **11*a* and 11*b*, spaced alternately and equidistantly about the tray axis so as to leave webs in between said holes and the central hole 8**.

The disks 9 are also provided with holes **12*a* and 12*b* equal both in number and diameter to the holes 11*a*, 11*b* and spaced likewise alternately and equidistantly about the axis of the trays 5 similarly to the holes 11*a* and 11*b***.

The holes **12*a*, 12*b* in the disks 9 are made open along their periphery and communicate with the space between the trays 5 through slots 13*a*, 13*b* provided one for each of the holes 12*a*, 12*b* and arranged radially with respect to the geometric axis of the shaft 2**. The size of the slots is accounted for by the provision of a required velocity of liquid flow therealong.

When the stack of the trays 5 with the spacer disks 9 is set on the shaft, the coaxial holes **11*a*, 12*a* align, thus establishing three ducts 14 (FIGS. 1,3) in the herein-considered embodiment of the invention, for the polluted liquid to feed from its source to the space between the trays 5, whereas the holes 11*b*, 12*b* are brought in alignment to define three ducts 15** for the cleaned-up liquid to let out into the discharge line.

Said ducts 14 and 15 run substantially parallel to the geometric axis 0—0 of the shaft 2 and communicate with distributing passages 16 and 17 provided by at least one in the end walls **1*a* and 1*b* of the shell 1 and passing substantially radially with respect to the geometric axis of the shaft 2**.

In the herein-described embodiment of the present invention the distributing passages in each of the end walls **1*a* and 1*b* are three in number, i.e., their amount is equal to the number of the ducts for a unidirectional flow of liquid in the interior of the shell 1. As it is evident from FIGS. 2 and 4 the distributing passages 16 and 17** are spaced 120° apart.

The distributing passages 16 communicate with an axial feed duct 18 (FIGS. 1,2) intercommunicated with a source of the polluted liquid while the passages 17 communicate with an axial outlet duct 19 (FIGS. 1,4) provided in the shaft 2 and intercommunicated with the purified liquid discharge line.

The distributing passages 16 and 17 are so arranged that each of the passages 16 is somewhat displaced with respect to the passage 17. In the herein-discussed embodiment of the invention, each of the passages 16 is displaced by 60° with respect to the respective passage 17.

It is due to the above feature that each of the polluted-liquid inlet ducts 14 and each of the cleaned-up outlet ducts 15 is open at one of its ends, while its other end is closed by the corresponding end wall of the shell 1. This causes the polluted liquid to pass from the ducts 14 for its inlet to the ducts 15 for the cleaned-up liquid within the intertray space.

The centrifugal separator for cleaning various liquid operates as follows.

The polluted liquid to be processed is fed to the rotating centrifugal separator from its source and is then passed, as indicated by the arrow A in FIG. 1, to the axial feed duct 18 provided in the shaft 2. Then the liquid is fed to each of the three distributing passages 16 provided in the end face 1*a* of the shell 1, from whence the three polluted-liquid inlet ducts run, and flows therealong in the direction facing the arrow B.

As the ducts 14 are open only on the side of the end wall 1*a* and are isolated from the end wall 1*b*, and due to the provision of the disks 9, the polluted liquid passes from the ducts 14 through the slots 13*a* made in the disks 9 to get into the space confined within the trays 5, as shown in FIG. 3 by the arrow C, to flow along said space towards the purified liquid outlet ducts 15, to which said liquid passes as indicated by the arrows D, through the slots 13*b* provided in the disks 9.

Inasmuch as the ducts 14 for polluted liquid and the ducts 15 for purified liquid are spaced equidistantly from the geometric axis 0—0 of the shaft 2, the liquid flows in the space between the trays 5 along substantially arcuate paths.

The contaminant solids contained in the liquid being processed are exposed to the effect of centrifugal forces acting for a lapse of time within which the liquid flows along the space between the trays 5, being thus propelled by virtue of said force in a radial direction to move away from the axis 0—0 of rotation; it is due to the fact that the radial movement of the solids is out of keeping with the arcuate motion of the liquid under process in the space between the trays 5, that the solids cross the arcuate path of the liquid flow moving along the space between the trays 5 and settle down upon the tapered wall portion 7 of the trays 5.

By virtue of the fact nearly every liquid treated in centrifugal separators has a certain viscosity, the forces of friction effective in the liquid causes the contaminant solids which settled down to perform an arcuate motion; on the other hand, centrifugal force causes the solids to move radially so that both of the forces acting upon the solids make the latter move along substantially an Archimedian sprial till settling down upon the tapered wall 7 of the tray 5.

The solids settled down upon the wall 7 of the tray 5 slip over the wall 7 of the tray 5 towards the periphery thereof under the effect of the centrifugal force that keeps acting thereon and, upon leaving the tray periphery settle down upon the inner surface of shell 1.

The thus-cleaned liquid passes through the slots 13*b* in the disks 9 to the ducts 15 for its discharge, flows along said ducts in the direction of the arrow E (FIG. 1) towards the end wall 1*b* of the shell 1, whereupon it flows through the distributing passages 17 in the end face 1*b* of the shell 1 to get to the axial outlet duct 19 in the shaft 2, wherefrom the liquid is passed in the direction indicated by the arrow F to the discharge line.

The layer of the contaminant solids settled down upon the wall of the shell 1 is disposed of by one of the known methods, that is, washing of the centrifugal separator while at standstill without its dismantling, mechanical removal of the deposit involving partial dismantling of the centrifugal separator, or by using an automatic deposit disposal device through appropriate holes in the shell of the centrifugal separator.

It will thus be seen that with the liquid-treating centrifugal separator of the invention, the fixed support structure 3 together with the bearings 4 form a support means supporting the shaft 2 and the hollow shell 1 which is fixed coaxially therewith for rotation about the axis of the shaft 2. A tray means is fixed in the hollow interior of the shell 1 to the shaft 2 for rotation therewith, this tray means of course including the plurality of trays 5 which have the central openings through which the shaft 2 extends, and the tray means of course includes the entire stack of trays 5 which have a given outer diameter and which are assembled into a stack fixed on the shaft 2 within the interior of the shell 1. The disks 9 form a spacer means including the several disks 9 which are situated between the several trays 5 so as to space them from each other, the several disks 9 of course also being formed with central openings through which the shaft 2 extends. These disks 9 have an outer diameter substantially smaller than the outer diameter of the trays, so that the disks 9 cooperate with the several trays to define between the latter a plurality of intertray spaces which circumferentially surround the disks 9. The above tray means and spacer means have a construction according to which they cooperate with each other to define a pair of liquid paths which extend parallel to the shaft 2, one of these paths being a path for the polluted liquid which is received to be treated by the separator while the other path is a path along which the purified liquid flows to be discharged from the centrifugal separator, and, more importantly, the above tray means and spacer means cooperate to define for the liquid which is treated a plurality of arcuate paths situated in the intertray spaces adjacent the outer periphery of the several disks of the spacer means and along which the treated liquid flows from the one of the pair of parallel paths which receive the polluted liquid to the other of the pair of parallel paths along which the purified liquid flows when being discharged. Because of the above plurality of arcuate paths for the liquid in the intertray spaces from one to the other of the pair of paths which extend parallel to the shaft, it is possible for the lighter liquid components to travel along the above arcuate paths from the one to the other of the parallel paths, while the heavier liquid components such as solids in the liquids are free to flow due to centrifugal force radially toward the outer peripheries of the several trays away from the several arcuate paths of the lighter liquid components, thus achieving in this way a highly effective centrifugal separating action. Of course, the above parallel paths for the polluted and purified liquid, respectively, are situated outwardly beyond the shaft 2 and include at least two openings formed in each tray with the openings of the several trays being axially aligned, although in the particular example illustrated there are also openings in the disks which are aligned with the tray openings, with these disk openings communicating with the radial slots 13*a*, 13*b* which extend from the disk openings to the outer peripheries of the disks.

A pilot model of the centrifugal separator for cleaning various liquids has passed trial testing the results of which have confirmed its high efficiency. The trial tests have been carried out on an oil with a viscosity of 12 to 20 cSt, intentionally polluted with the solids of $Al_2O_3$ to a concentration of 50 mg/liter, the size of the solids of said impurities ranging from 2 to 10 mcm. The efficiency of the centrifugal separator has been equal to 100 liter/min. No solids sized in excess of 2 mcm have been found in the oil sample after cleaning in the centrifugal separator.

The pilot model of the centrifugal separator is 150 kg. The apparatus occupies but small area, is simple and reliable in service.

What is claimed is:

1. In a liquid-treating centrifugal separator, support means, a shaft supported for rotation about its axis by said support means, a hollow shell rigidly coupled coaxially with and surrounding said shaft so as to rotate therewith, said shell having a hollow interior surrounding said shaft, tray means situated in the hollow interior of said shell, said tray means including a stack of trays of a given outer diameter respectively formed with central openings through which said shaft extends, and said trays of said tray means also being fixed to said shaft for rotation with said shaft and shell, and spacer means cooperating with said trays of said tray means for maintaining said trays spaced from each other, said spacer means including a plurality of disks respectively formed with central openings through which said shaft extends and also being fixed with said shaft for rotation therewith, said plurality of disks respectively having outer diameters substantially smaller than the outer diameters of said trays and said disks being respectively situated between said trays for spacing the latter apart from each other and for creating between said trays a plurality of intertray spaces which respectively circumferentially surround said disks, said tray means and spacer means cooperating with each other for defining in said shell at least one pair of liquid-flow paths extending parallel to said shaft and a plurality of arcuate liquid-flow paths respectively situated in said intertray spaces adjacent the outer peripheries of the disks and extending from one to the other of said pair of paths, said one path being a path for receiving liquid to be treated while said other path forms a discharge path for treated liquid, so that lighter liquid components will travel along said arcuate paths from said one to said other path, while heavier liquid components will due to centrifugal force move outwardly beyond said arcuate paths toward the peripheries of said trays to be separated from the lighter liquid components and to be prevented from discharging with the lighter liquid components through said other path.

2. The combination of claim 1 and wherein said pair of parallel liquid-flow paths are situated outwardly beyond said shaft.

3. The combination of claim 2 and wherein said pair of parallel liquid-flow paths are formed at least in part by openings in said trays which form at least a pair of rows of openings which extend parallel to said shaft.

4. The combination of claim 3 and wherein said disks are formed with openings aligned with said rows of tray openings and cooperating therewith for defining said pair of parallel liquid-flow paths, said disks respectively being formed with slots extending from said openings of said disks which form part of said pair of parallel liquid-flow paths to the outer peripheries of said disks.

5. The combination of claim 1 and wherein said shaft is maintained by said support means in an upright attitude and said shaft being formed with an upper inlet passage communicating with said one of said pair of parallel liquid-flow paths and with a lower outlet passage communicating with the other of said pair of parallel liquid-flow paths.

6. The combination of claim 5 and wherein said trays have beyond said disks outer circumferential portions which taper downwardly and outwardly toward the outer peripheries of said trays.

7. The combination of claim 1 and wherein said trays have beyond said disks outer circumferential portions which taper downwardly and outwardly toward the peripheries of said trays.

* * * * *